United States Patent [19]

Hyder et al.

[11] 4,418,970

[45] Dec. 6, 1983

[54] ROTARY-POSITION CATCH FOR ROTATABLE SHELF UNITS

[75] Inventors: Marvin W. Hyder, Rockford; Steven F. Weinstock, Ada, both of Mich.

[73] Assignee: Leslie Metal Arts Company, Grand Rapids, Mich.

[21] Appl. No.: 236,158

[22] Filed: Feb. 20, 1981

[51] Int. Cl.[3] ..... A47B 81/00; A47F 3/10

[52] U.S. Cl. ..... 312/305; 312/125; 312/135; 312/238

[58] Field of Search ..... 312/305, 238, 135, 125, 312/186, 197, 11; 292/107, 209, 204; 403/1; 211/144; 248/289.1, 475 B

[56] References Cited

U.S. PATENT DOCUMENTS

| | | | |
|---|---|---|---|
| 379,252 | 3/1888 | Thatcher . | |
| 456,728 | 7/1891 | Lamson . | |
| 1,101,880 | 6/1914 | Quinn . | |
| 2,574,726 | 11/1951 | Best | 292/204 |
| 2,607,612 | 8/1952 | Schatzman | 292/209 |
| 2,698,776 | 1/1955 | Stoeckl | 312/305 |
| 3,017,207 | 1/1962 | Lloyd | 403/1 |
| 3,160,453 | 12/1964 | Tassell . | |
| 3,266,857 | 8/1966 | Anderson . | |
| 3,281,195 | 10/1966 | Shownes . | |
| 3,281,197 | 10/1966 | Anderson . | |
| 3,468,428 | 9/1969 | Reibold | 211/144 |
| 3,507,531 | 4/1970 | Smith | 292/209 |
| 3,733,112 | 5/1973 | Marquardt . | |
| 3,868,156 | 2/1975 | VanderLey . | |
| 3,888,354 | 6/1975 | Margolin et al. | 248/289.1 |
| 3,982,800 | 9/1976 | Gorton et al. . | |
| 4,146,280 | 3/1979 | Crownhart | 312/305 |
| 4,181,037 | 1/1980 | Boon et al. | 312/305 |

*Primary Examiner*—Victor N. Sakran

*Attorney, Agent, or Firm*—Varnum, Riddering, Wierengo & Christenson

[57] ABSTRACT

A rotary-position catch (30) for a lazy susan (20) includes a prism element (40) with at least one dog (42) which receives at least one recess (50) of an oblong element (48) in an interference-type fit. One of the elements (40, 48) is secured to one end of a shaft (24) of the lazy susan (20) and the other element is secured to a cabinet (10) adjacent the one end of the shaft (24). The interference-type fit provides a catch for holding the shaft (24) of the lazy susan (20) in a selected rotary position.

12 Claims, 5 Drawing Figures

ROTARY-POSITION CATCH FOR ROTATABLE SHELF UNITS

TECHNICAL FIELD

The invention relates to a rotary-position catch for rotatable corner shelf units, such as a corner cabinet lazy susan.

BACKGROUND ART

It is common to install rotary cabinet units in corner cabinet spaces in kitchens. Such rotary cabinet units or "lazy susans" have become popular as they allow for access to otherwise inaccessible areas of cabinets. In such "lazy susans", it is desirable to include a rotary catch which holds the rotary unit in a selected rotary position so that the door panels of the rotary cabinet will be maintained flush with the cabinet walls when the "lazy susan" is closed.

Various rotary catch arrangements have been used with "lazy susans" in the past. The rotary cabinet units are mounted within a corner cabinet for rotation about a vertical axis. The units are provided with a cam mounted on the axis and a notch member mounted to the cabinet which fits within a recess of the cam. The cam and notch are aligned so that the door panels fit flush with the cabinet opening when the notch fits within the recess of the cam.

An example of the above-described catch is shown in U.S. Pat. No. 3,982,800, issued Sept. 28, 1976. The catch includes a plastic mounting plate and a metal sleeve. The plastic mounting plate includes an oblong ring disposed about a central pivot bearing. The mounting plate is secured to the cabinet. The oblong ring is connected to the plate at diametrically opposed points on the major diameter thereof and includes recesses at diametrically opposed points on the minor diameter. The metal sleeve is secured to the shaft about which the storage unit rotates. Catch-engaging lugs in the sleeve extend outwardly from the sleeve and snap into the recesses when aligned therewith to hold the lazy susan in a selected position.

U.S. Pat. No. 3,868,156, issued Feb. 25, 1975, discloses a catch arrangement for a rotatable shelf unit having a cam arrangement which lifts the shelf unit for free rotation about an axis. The cam arrangement includes a downwardly-facing cam on a bearing which cooperates with a complementary upwardly-facing cam on a bottom shelf mounting bracket. When the storage unit is rotated to the closed position, the weight of the shelf unit causes the downwardly-facing cam carried on the shelf unit to drop into engagement with the upwardly-facing cam and thus maintain the door panels of the cabinet in the closed position.

Another arrangement is disclosed in U.S. Pat. No. 3,281,197, issued Oct. 25, 1966. The '197 patent discloses a roller assembly for positioning a corner shelf wherein the roller assembly has an annular cam fixed to the shelf frame and an adjacent roller supported on the cabinet. The roller is spring-biased so as to urge the roller against the cam surface. The cam has a a peripheral notch which receives the roller so as to establish a normally closed position of a cabinet.

DISCLOSURE OF THE INVENTION

According to the invention, a rotary-position catch includes a hollow prism element and an oblong element, wherein one of the elements is secured to one end of a rotatable shaft and the other element is secured to a surface adjacent the one end of the shaft. At one point of rotation of the shaft the prism element is received by the oblong element in an interference-type fit, thereby holding the shaft in a selected rotary position. Typically, the shaft is part of a corner cabinet lazy susan structure, while the surface is part of a kitchen corner cabinet. Both elements are typically made out of plastic material.

The hollow prism element has an axis coincident with the shaft and includes at least one dog which extends inwardly from at least one side of the element. The distance between the innermost point of the at least one dog and the axis of the shaft is less than the distance between the axis of the shaft and the remaining sides of the element.

The oblong element is concentrically disposed within the prism element. The oblong element has at least one recess at a major diameter thereof with the innermost point of the recess positioned at a distance about equal to the distance between the at least one dog of the prism element and the axis of the shaft. Upon rotation of the shaft the recess is adapted to receive the at least one dog in an interference-type fit at one or more selected points of rotation. The shaft is thereby maintained at a selected rotary position. The shaft may be freely rotated at all other points of rotation.

BRIEF DESCRIPTION OF THE DRAWINGS

The invention will now be described with reference to the accompanying drawings in which.

Figure 1:
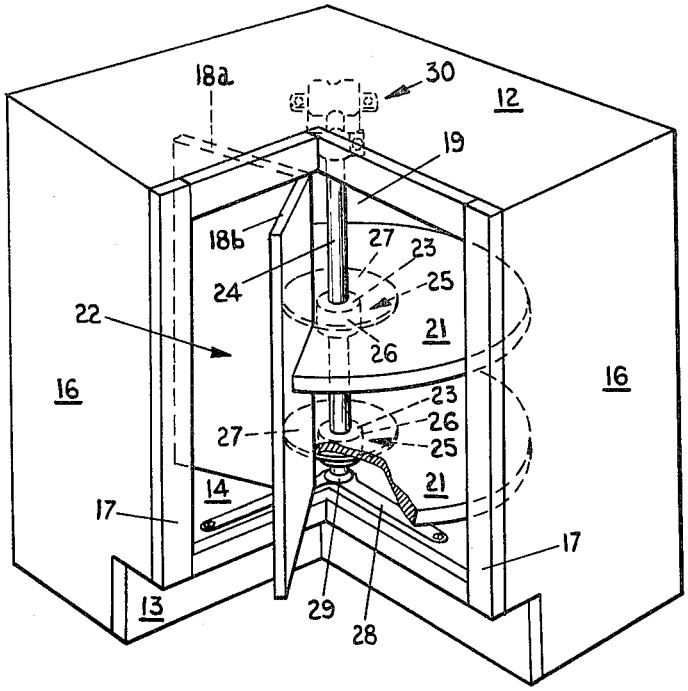
FIG. 1 is a perspective view of a storage unit embodying the invention shown in an open position within a corner cabinet.

Within the cabinet 10 is a storage unit 20, referred to as a rotatable lazy susan, rotatably mounted between the top and bottom walls 12 and 14. The panels **18*a* and 18*b*** are secured to and rotatable with the lazy susan 20. The lazy susan 20 includes shelves 21 having a pie-slice cut-out 22 which corresponds to the corner mounting of the cabinet, and a hole 23 provided at the center of the shelves 21 which receives a central shaft 24. The vertical panels 18*a* and 18*b* are mounted to the edges of the shelves 21 bordering the pie-slice cut-out 22. The shelves 21 are made of wood or plastic.

The shelves 21 are spaced apart along the shaft 24 and are mounted to the shaft 24 by hubs 25. The hubs 25 include a flat mounting plate 27 which supports each shelf 21 and a cylindrical section 26 integral with the plate 26 and depending therefrom. The plate 27 is mounted to the bottom of each shelf 21 by screws, while the cylindrical section 26 is secured to the shaft 24 by a conventional fastener, such as a set screw or wingnut. The hubs 25 can be made out of plastic or metal.

A bracket 28 having two perpendicular arms is mounted to the bottom wall 14 of the cabinet 10 through screws (not shown). The bracket 28 mounts a pivot bushing 29 in which the bottom section of the shaft 24 is rotatably received. The top of the shaft 24 engages a rotary-position catch 30 described in detail below. The shaft 24 is thus rotatably mounted between the bushing 29 and the catch 30.

Figure 3:
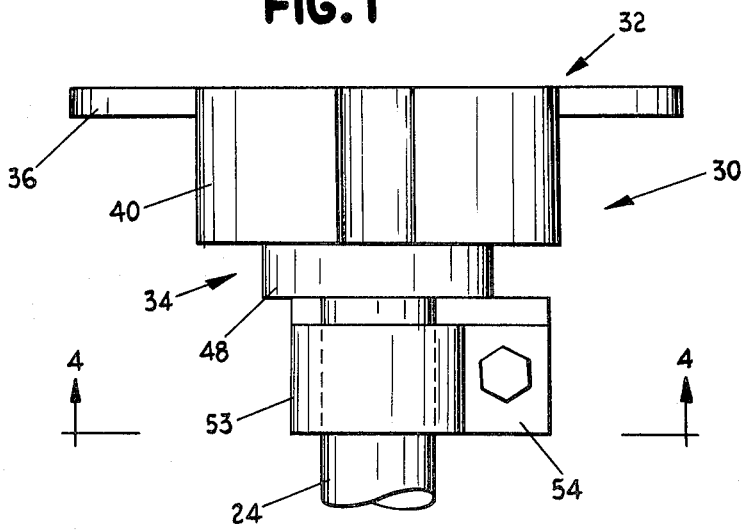
FIG. 3 is a side elevational view of the rotary-position catch in accordance with the invention.
Figure 2:
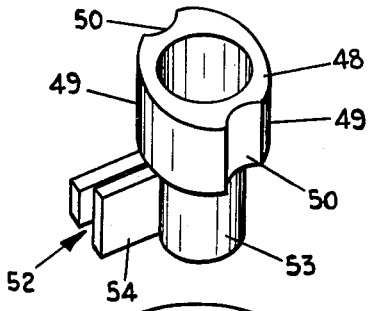
FIG. 2 is an exploded perspective view of the rotary catch and the bottom support for the storage unit shown in FIG. 1.
Figure 2:
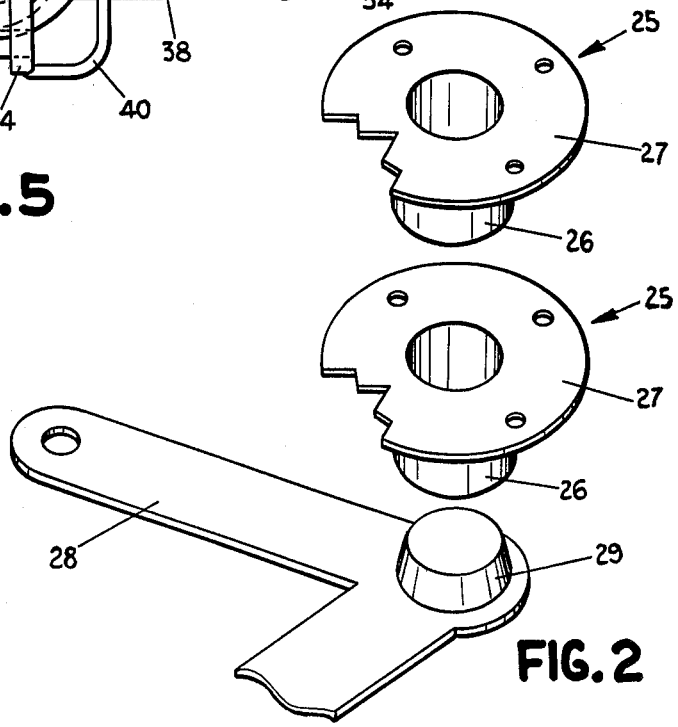

Referring to FIGS. 2 and 3, the rotary-position catch 30 includes a stationary member 32 mounted to the top wall 12 of the cabinet which engages a rotary member 34 rotatable with the shaft 24. The stationary member 32 is coaxial with and disposed concentrically about the rotary member 34 and, thereby, serves as a catch for the shaft 24 of the lazy susan 20. The stationary member 32 includes a mounting plate 36, a hollow prism element 40 integral with the mounting plate 36, and a cylindrical pivot bearing 44 coaxially mounted within the prism element 40 on the mounting plate 36. The mounting plate 36 is a flat strip having two diametrically opposed mounting holes 38. Both the prism element 40 and the pivot bearing 44 are integrally molded with the mounting plate 36 and are positioned between the two mounting holes 38. The stationary member 32 is secured to the top wall 12 with fasteners inserted through the holes 38 in the mounting plate 36.

The prism element 40 extends downwardly from the mounting plate 36. The prism element 40 is preferrably square or rectangular in shape, but need not be limited to these shapes. When mounted, the prism element 40 has an axis coincident with the axis of the shaft 24. The prism element 40 includes at least one dog 42 formed by an inwardly-directed indentation on at least one side 40*a* of the prism element 40.

If the prism element 40 is square or rectangular in shape, it is desirable to include two dogs 42 disposed on opposing sides 40*a* of the prism element 40. The distance between the innermost point of each dog 42 and the axis of the shaft 24 is less than the distance between the axis of the shaft 24 and the remaining inner sides 40*b* of the prism element 40.

The prism element 40 is concentrically disposed about the pivot bearing 44, which extends downwardly from the mounting plate 36, as does the prism element 40. The pivot bearing 44 includes an aperture which receives the shaft 24 within the stationary member 32. The pivot bearing 44 is received within the rotary member 34 to rotatably mount the shaft 24.

The rotary member 34 includes an oblong element 48 secured to the upper end of the shaft 24, the oblong element 48 being received within the annular space between the pivot bearing 44 and the prism element 40. Extending downwardly from the oblong element 48 is a cylindrical portion 53 having a reduced diameter relative to the oblong element 48. The cylindrical portion 53 has lugs 54 which extend outwardly therefrom for securing the oblong element 48 to the shaft 24. The lugs 54 include holes 56 which receive a fastener (not shown) such as a screw, which when tightened, clamps the rotary member 34 to the shaft 24.

Along the major diameter of the oblong element 48 and disposed on the outer circumference thereof are two recesses 50. The distance between the axis of the shaft 24 and the innermost point of the recesses 50 is about equal to the distance between the innermost point of the dogs 42 of the prism element 40 and the axis of the shaft 24. The recesses 50 thus receive the dogs 42 in an interference-type fit. The distance between the axis of the shaft 24 and a circumferential wall 49 of the oblong element 48 adjacent the recesses 50 is greater than the distance between the shaft 24 and the dogs 42. It is necessary to apply a force to the rotary member 34 to overcome the interference at the walls 49 of the oblong element 48 adjacent the recesses 50 so as to force the dogs 42 into the recesses 50. Thus, when the shaft 24 is rotated, the dogs 42 are received in the recesses 50 in an interference-type fit, so as to maintain the shaft 24, and the lazy susan 20 in a desired position.

The positions of the recesses 50 of the rotary member 34 with respect to the dogs 42 of the stationary member 32 are selected so that when the dogs 42 are received within the recesses 50 the panels 18*a* and 18*b* are flush with the front wall 17 of the cabinet 10 so as to cover the opening 19 or 180° therefrom. When the dogs 42 are forced out from the recesses 50 and are, therefore, not received in the recesses 50, the rotary member 34 can be freely rotated with the shaft 24, since the dogs 42 or sides of the prism element 40 do not hinder the rotational movement of the rotary member 34. In this regard, the distance between the axis of the shaft 24 and wall 49 of the oblong element 48 away from the recess 50 is less than the distance between the shaft 24 and the dogs 42.

Both the stationary member 32 and the rotary member 34 are preferably molded out of plastic. One of members 32 and 34 may be made out of metal, but is is necessary that at least one of members 32 and 34 be made of a resilient or flexible material so as to allow for deflection when the interference between the oblong element 48 and dogs 42 is overcome. The rectangular shape of the prism element 40 adds significant flexibility to the catch 30 compared with a round or oval shape. Flexibility is provided at the sides as well as the corners of the rectangular shape of the prism element 40.

Figure 4:
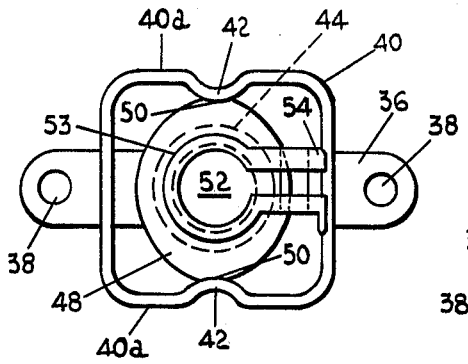
FIG. 4 is a sectional view taken along line 4—4 of FIG. 3 showing the rotary catch in the stop position.

FIG. 4 shows the rotary-position catch 30 in the closed position with the rotary member 34 and the stationary member 32 engaged in an interference-type fit. The recesses 50 on the major diameter of the oblong element 48 snap into alignment with the inwardly-extending dogs 42 of the prism element 40. The dogs 42 provide a yieldable impediment to the oblong element 48, thereby fixing the position of the vertical panels 18*a* and 18*b* relative to the front wall 17 of the cabinet 10. Only one dog 42 and one recess 50 are needed to fix the door 18 and lazy susan 20 at the desired position. If more than one closed or stop position is desired, one or more recesses 50 and one or more dogs 42 can be provided so that the recesses 50 will receive the dogs 42 in an interference-type fit at various rotary positions.

Figure 5:
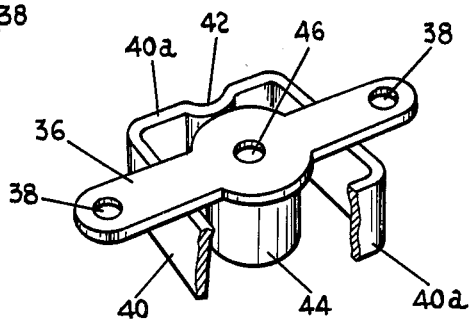
FIG. 5 is a view similar to FIG. 4 showing the rotary catch in the free position. BEST MODE FOR CARRYING OUT THE INVENTION Referring to FIG. 1, a corner cabinet 10, typically a kitchen corner cabinet, has a top wall 12, a bottom wall 14, side walls 16, front walls 17 and a back wall (not shown). Such a cabinet 10 can be positioned above or below a kitchen countertop and serves to store items anywhere within the cabinet 10, including the extreme rear, corners of the cabinet 10, which are usually inaccessible. If the cabinet 10 is placed below the cabinet top, a toe recess 13 can be provided at the bottom of the cabinet 10 to facilitate opening of the cabinet. Two vertical panels **18*a* and 18*b* disposed at right angles to each other cover an opening 19 in the front wall 17 of the cabinet 10. The panels 18*a* and 18*b* are aligned flush with the front wall 17 of the cabinet 10 when the cabinet is closed. The panels 18*a* and 18*b* which cover the opening 19 are secured to a storage unit to be described below which is releasably held in a closed position by a rotary-position catch 30** in accordance with the invention.
Figure 5:
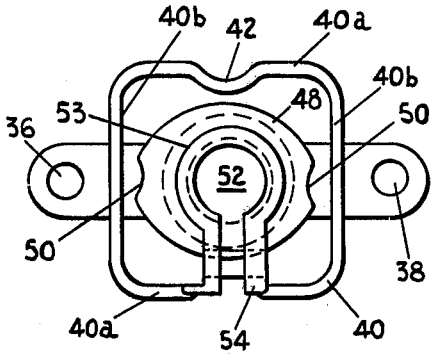

FIG. 5 shows the rotary-position catch 30 in an unlocked, freely rotatable position, wherein the oblong element 48 is not in contact with the prism element 40. Likewise, the dogs 42 are not in contact with the recesses 50. The interference-type fit is overcome by moving the shelves 21 or the panels 18*a* and 18*b* mounted to the shaft 24. When the lazy susan 20 is rotated from the closed position, the wall 49 of the oblong element 48 adjacent the recesses 50 flexes the dogs 42 outwardly so as to overcome the interference and allow for rotation of the shelves 21.

When the rotary catch 30 is set in the closed position and mounted to the cabinet 10 and lazy susan 20, the panels 18*a* and 18*b* will be flush with the front wall 17 of the cabinet 10. The installation of the rotary catch 30 into the cabinet 10 is accomplished by mounting the cylindrical portion 53 of the rotary member 34 to the shaft 24 by inserting a fastener through holes 56 of the lugs 54. Fasteners are also inserted into holes 38 of the mounting plate 36 to secure the stationary member 32 to the top wall 12 of the cabinet 10.

It should be understood that the reversal of the parts of the catch 30 is contemplated. Thus, while the embodiment shown is preferred, one could mount the prism element 40 and the pivot bearing 44 to the shaft 24, and mount the oblong element 48 to the cabinet 10. The recess 50 of the pivot bearing 44 would still receive the dogs 42 of the prism element 50 in an interference-type fit upon rotation of the shaft 24, so as to maintain the shaft 24 in a selected rotary position.

Whereas the invention has been described with reference to a four sided prism element 40, the mounting contemplates other shaped prism elements. For example, a three sided or five or more sided prism element can be used in accordance with the invention.

The foregoing description and drawings are merely illustrative of the invention and are not intended to limit the invention to the above-described embodiments. Variations and changes which may be obvious to one skilled in the art may be made without departing from the scope and spirit of the invention which is defined in the appended claims.

The embodiments of an invention in which an exclusive property or privilege is claimed are defined as follows:

1. A rotary-position catch for holding a shaft in a selected rotary position, the shaft being rotatable about an axis and supported by bearing means between two surfaces, the catch comprising:

a hollow prism element made of a flexible plastic material, being coaxial with the shaft and having at least one inwardly-extending dog on at least one side of the element, said at least one side flexing at adjacent corners of said prism element, the distance between the innermost point of the at least one dog and the axis of the prism element being less than the distance between the axis of the prism element and the remaining sides of the prism element;

an oblong element having at least one recess in a peripheral wall thereof at a major diameter of the oblong element, the distance between the axis of the shaft and the innermost point of the recess being about equal to the distance between the at least one dog of the prism element and the axis of the shaft, the at least one recess being adapted to receive the at least one dog in an interference-type fit, the oblong element being concentrically disposed within the prism element, one of the hollow prism elements and the oblong elements being mounted to one end of the shaft, the other of the hollow prism elements and the oblong elements being mounted to one of the surfaces adjacent the one end;

whereupon rotation of the shaft, the at least one dog is received in the at least one recess in an interference-type fit so as to maintain the shaft in a selected rotary position.

2. The rotary-position catch according to claim 1 wherein the hollow prism element is square and has one dog on one side thereof.

3. The rotary-position catch according to claim 2 wherein the prism element includes two dogs disposed on opposing sides of the prism element, said opposing sides flexing at adjacent corners thereof.

4. The rotary-position catch of claim 3 wherein the oblong element includes two recesses on the major diameter thereof.

5. The rotary-position catch according to claim 1 and further comprising a mounting plate including two diametrically opposed holes for securing the same to one of the two supporting surfaces, the prism element and bearing means being integral with the mounting plate and positioned between the two holes and said mounting plate being joined to said prism element along sides other than said side on which said at least one dog is disposed.

6. The rotary-position catch according to claim 1 and further comprising:

means for securing the oblong element to the shaft.

7. In an improved lazy susan having a central, pivotably mounted shaft being rotatable about an axis and supported by bearing means with a cabinet structure, at least one shelf secured to said shaft for rotation therewith, and catch means for holding the shaft in a selected rotational position relative to the cabinet structure, the improvement which comprises:

a hollow prism element made of a flexible plastic material, having an axis coaxial with the shaft and including at least one inwardly-extending dog on at least one side of the element, said at least one side flexing at adjacent corners thereof, the distance between the innermost point of the at least one dog and the axis of the prism element being less than the distance between the axis of the prism element and the remaining sides of the element; and an oblong element including at least one recess on a peripheral wall thereof at a major diameter of the oblong element, the distance between the axis of the shaft and the innermost point of the recess being about equal to the distance between the at least one dog of the hollow prism element and the axis of the shaft, the at least one recess being adapted to receive the at least one dog in an interference-type fit, the oblong element being concentrically disposed within the prism element, one of the hollow prism element and the oblong element being mounted to one end of the shaft, the other of the hollow prism elements and the oblong elements being mounted to the cabinet structure adjacent the one end;

whereupon rotation of the shaft, the at least one dog is received in the at least one recess in an interference-type fit so as to maintain the lazy susan structure in a selected rotary position.

8. The improved lazy susan according to claim 8 wherein the hollow prism element is square and has one dog on one side thereof.

9. The improved lazy susan according to claim 9 wherein the prism element includes two dogs disposed on opposing sides of the prism element, said opposing sides flexing at adjacent corners thereof.

10. The improved lazy susan according to claim 10 wherein the oblong element includes two recesses on the major diameter thereof.

11. The improved lazy susan according to claim 8 and further comprising a mounting plate including two diametrically opposed holes for securing the prism element to the cabinet structure, the prism element being integral with the plate and positioned between the two holes, and said mounting plate being joined to said prism element along sides other than said side on which said at least at one dog is disposed.

12. The improved lazy susan according to claim 8 and further comprising:

a cylindrical portion integral with and depending from the oblong element; and clamping means on said cylindrical portion for securing the oblong element to the shaft.

* * * * *

UNITED STATES PATENT AND TRADEMARK OFFICE

CERTIFICATE OF CORRECTION

PATENT NO. : 4,418,970

DATED : December 6, 1983

INVENTOR(S) : Marvin W. Hyder and Steven F. Weinstock

It is certified that error appears in the above-identified patent and that said Letters Patent are hereby corrected as shown below:

Col. 2, line 54, "cabinet" (second occurrence) should read --counter--.

Col. 4, line 45, "is is" should read --it is--.

Col. 6, lines 9 and 10, "interferencetype" should read --interference-type--.

Col. 7, line 3, "8" should read --7--.

Col. 7, line 6, "9" should read --8--.

Col. 7, line 10, "10" should read --9--.

Col. 7, line 13, "8" should read --7--.

Col. 8, line 8, "8" should read --7--.

Signed and Sealed this

*Nineteenth* Day of *June 1984*

[SEAL]

*Attest:*

*Attesting Officer*

GERALD J. MOSSINGHOFF

*Commissioner of Patents and Trademarks*